US006108828A

United States Patent [19]

Cheng

[11] Patent Number: 6,108,828

[45] Date of Patent: Aug. 29, 2000

[54] DRAIN COVER ASSEMBLY

[76] Inventor: Jip Cheng, 123 Westview Ave., Paramus, N.J. 07652

[21] Appl. No.: 09/226,447

[22] Filed: Jan. 6, 1999

Related U.S. Application Data

[60] Provisional application No. 60/096,675, Aug. 18, 1998.

[51] Int. Cl.[7] ..... A47K 1/14; E03C 1/26

[52] U.S. Cl. ..... 4/287; 4/286

[58] Field of Search ..... 4/286–295, 256.1, 4/652

[56] References Cited

U.S. PATENT DOCUMENTS

| | | | |
|---|---|---|---|
| 774,201 | 11/1904 | Robischon | 4/289 |
| 2,707,287 | 5/1955 | Hiertz | 4/287 |
| 2,890,463 | 6/1959 | Young | 4/287 |
| 3,777,320 | 12/1973 | Politz | 4/287 |
| 3,800,339 | 4/1974 | Bergin | 4/287 |
| 3,802,001 | 4/1974 | Richards | 4/287 |
| 3,813,708 | 6/1974 | Hamburg | 4/286 |
| 4,320,540 | 3/1982 | Leavens | 4/287 |
| 4,586,203 | 5/1986 | Westgerdes | 4/287 |
| 4,683,597 | 8/1987 | Taylor, Jr. et al. | 4/295 |
| 4,720,877 | 1/1988 | Watts | 4/286 |
| 5,369,815 | 12/1994 | Martin | 4/287 |
| 5,418,983 | 5/1995 | Garguillo et al. | 4/287 |
| 5,535,455 | 7/1996 | Liu | 4/287 |

*Primary Examiner*—Henry J Rocla
*Assistant Examiner*—Tuan Nguyen
*Attorney, Agent, or Firm*—Wolff & Samson

[57] ABSTRACT

An improved drain cover assembly for a sink is provided. The assembly includes a generally cylindrical basket having a flat bottom. A sealing plate is attached to the underside of the flat bottom. A plurality of apertures sized to permit the drainage of liquids from the sink, but prevent solid materials from passing therethrough, are located on the bottom of the basket about the sealing plate. An externally threaded member extends from the bottom of the sealing plate. The plug may be cylindrically shaped or frustoconically shaped and is press fit into a drainpipe. The plug has an open upper end and a bottom surface. The bottom surface contains a plurality of apertures to allow for liquid to drain but to prevent solid materials from passing therethrough. The bottom surface of the plug has an internally threaded member extending upwardly therefrom which mates with the threaded member extending from the bottom of the sealing plate. The upper edge of the plug contacts the sealing plate to seal the drain cover assembly when the basket is threaded down on the plug. The assembly is opened by rotating the basket with respect to the plug from a space between the sealing plate and the plug to allow liquid to drain therethrough.

15 Claims, 6 Drawing Sheets

DRAIN COVER ASSEMBLY

RELATED APPLICATIONS

This application claims the benefit of U.S. Provisional Application Ser. No. 60/096,675, filed Aug. 18, 1998.

BACKGROUND OF THE INVENTION

1. Field of the Invention

This invention generally relates to a drain cover assembly for a sink, and more specifically, to a drain cover having an upper basket member threadably interconnected with a lower plug member positioned within a sink drain pipe, the drain cover assembly capable of being opened and closed by rotating the basket with respect to the plug.

2. Related Art

Sinks are used in industrial and residential applications and drain covers are a necessary component of these sinks. Drain covers have two basic functions. The first function is to stop liquid from draining thus allowing the sink to be filled with liquid. The second function is to open the sink to allow while acting as a strainer to prevent solid material from being drawn down the drain.

Sink drain cover assemblies generally include a basket strainer having a plurality of holes and a strainer post extending up therefrom. A stopper, which fits within the sink drain pipe opening, may be mounted on a lower portion of the post. The basket strainers of this type are adapted to be opened and closed manually by manipulating the post, so as to align bulges in the post with slots in the basket in order to raise and lower the post, and hence the stopper, with respect to the basket, permitting draining and filling of the sink.

Alternatively, the basket itself may close off the drain, the post coacting with a bridge member in the drain pipe of the sink to maintain the basket off the drain or to allow the basket to move down against the drain. Such a drain basket generally includes a rubber gasket mounted on the underside of the basket. These basket covers generally rely on the weight of the water in the sink to push the gasket on the basket against the drain opening to prevent water from draining from the sink. It has been found, however, that the weight of the water in the sink sometimes does not create enough downward force to provide a leakproof seal, and accordingly, there may be some leakage by such prior art basket strainers. Both types of drain cover assemblies have baskets with a central post which makes cleaning difficult and time consuming. To clean these baskets, one has to remove the basket from the drain. If the sink is not fully drained, this can result in solid materials flowing down the drain which can lead to subsequent problems that may require the need of a plumber.

Accordingly, what is needed, and has not heretofore been provided, is a drain cover assembly which can stop a sink and which can also strain solid material from a liquid draining from a sink, and which can be opened and closed by rotating the basket portion with respect to a plug portion. Additionally, what is needed is a plug with apertures to prevent solid material from escaping down the drain pipe when the basket is removed. Additionally, it would be beneficial to have a basket with depressions for gripping so as to make the basket easily to grasp and rotate, and to have a basket which is shaped to facilitate easy cleaning, and which has a plug which is shaped so as to fit drain pipes of varying sizes.

Previous efforts to create sink drain cover assemblies include:

Liu, U.S. Pat. No. 5,535,455, discloses a sink strainer for a garbage disposal unit which includes a strainer unit, a seat and a mounting flange. The strainer unit includes a handle (11) which extends up from the strainer member. The strainer member (12) which is interconnected with a plug member (13), has a plurality of openings spaced thereabout. The plug member has a platform and a surrounding wall that depends therefrom. Multiple slope guides are contained in the surrounding wall. The strainer member interconnects with the plug member by means of threaded engagement of the handle. Mounting flanges are adapted to fit into a conventional sink. A limiter on the seat coacts with the slope guide to interconnect the strainer member with the seat. The seat is inserted into the mounting flange. When the limiter is inserted into the slope guide and turned, the plug member is forced to go down to seal the drain closed, while turning the plug in a counter direction allows the plug to move upward with respect to the limiter to produce a gap, resulting in an open position making drainage possible.

Martin, U.S. Pat. No. 5,369,815, discloses a sink strainer having a hollow strainer body with an open upper end and a tubular outlet at a lower end. A basket strainer is mounted in the upper end and a tubular outlet at a lower end. A basket is mounted in the upper end. The basket strainer has a bottom wall with a valve stem guide. A valve stem extends through the guide and a handle is secured to an upper end of the valve stem. An outlet member is positioned below the strainer body having screw threaded portion for engagement with a lower end of the valve stem. An annular valve member is secured to the valve stem below the basket strainer. When the stem valve handle is turned on the handle in the opposite direction the annular valve member is raised off the annular valve seat, and when the valve stem is turned on the handle in the opposite direction the valve member and its annular seal will move downwardly against the annular valve seat.

Watts, U.S. Pat. No. 4,720,877, discloses a drain closure having a stopper mounted to slide up and down on a post threaded into the bottom of a strainer body. The post includes a spring which expands against the internal surface of the stopper to provide frictional force to hold the stopper in place. When the stopper is pulled upwardly to an open position it is held open by the frictional force. The stopper can be pushed down to a closed position by foot or hand pressure in which case the spring helps to maintain the stopper in a closed position.

Westgerdes, U.S. Pat. No. 4,586,203, discloses a sink strainer assembly including a strainer body having a threaded bore, a strainer basket having a bottom wall formed with a bore, a post formed with a top handle, a bottom threaded portion and a reduced diameter middle portion, and a rubber stopper having a bore of the same diameter as the middle portion of the post. The strainer basket is mounted to the post and the rubber stopper is forced over the threaded bottom of the post and sits within the middle portion contacting the underside of the strainer. The strainer basket, post and stopper can be inserted as a unit into the strainer body where the threaded bottom portion of the post meets with the threaded bore of the strainer. The post is rotatable to lower the rubber stopper into sealing engagement with the annular shoulder to close the drain, or to raise the rubber stopper to open the drain.

Hamburg, U.S. Pat. No. 3,813,708, discloses a kitchen sink strainer and drain unit including a drain bowl passing within a drain opening of the sink having a keyhole slot opening in the bottom. A wedge shape cam is formed around the opening on the bottom surface of the drain bowl. A strainer is nested in the drain bowl and has a central stem extending from the strainer through the keyhole slot with a radical projection engaged with the cam beneath the drain bowl to seal the strainer downwardly against the drain bowl interior wall. A spring surrounding the stem forces the strainer upwardly for spacing the strainer from the drain bowl for opening the drain or drainage when the strainer is rotated to disengage the projection from the cam. A hand grip is formed across the interior of the strainer to allow for grasping and rotating the strainer.

Richards, U.S. Pat. No. 3,802,001, discloses a basket assembly for a sink strainer having a stem with a lower end having a pilot element to project through the strainer body with thread means positioned above the pilot element. The threaded portion provides a platform for engaging the basket to advance the basket to seat the basket against the drain, and on the other hand, to provide a ledge adapted to support the basket against a slot in the drain to maintain the drain in an open position. The stem includes an upper end extending through the strainer for grasping.

Bergin, U.S. Pat. No. 3,800,339, discloses a sink stopper mounted on a drain of a sink having a threaded step. A plug which is part of the stopper is threaded over the top of the stem and is moveable from a closed position in which the plug engages an annular member to plug the fluid opening, to an open position in which the plug is spaced from the annular member to permit fluid flow.

Politz, U.S. Pat. No. 3,777,320, discloses a drain having a drain body with a flange for support in a sink opening, a reduced drain outlet section with a downwardly opened threaded section provided at upper end with a beveled section so that the open portion can be guided over a spud to close off the drain to retain liquid in the sink. A stem extends up from the basket for grasping the device.

Leavens, U.S. Pat. No. 4,320,540, disclosed a discharge drain assembly including a drain body and a plug adapted to fit in the drain. The plug includes a stainless steel strainer with a hollow knob. The knob retains a slotted head of a spindle. The spindle has a neck for receiving a sealing washer and a lower portion with three legs which support the plug in an opened position and restrain rotation in a first direction beyond the open position. The leg portions also cam the plug to a closed position when rotated in a direction opposite to the first direction.

Taylor, Jr., et al., U.S. Pat. No. 4,683,597, discloses a drain plug comprising threaded bolt extending through a rubber washer. The bolt is screwed into a tapped hole in a shoe assembly of the drain providing a secure plug.

Young, U.S. Pat. No. 2,890,463, discloses sink strainer having a hollow body with an outlet portion on a lower end having a valve seat and a cup for allowing liquid to drain therefrom. A handle can be used to move the cup up and down with respect to the valve seat to open and close the device.

The citation of any reference herein should not be deemed an admission that such reference is available as prior art to the invention. None of these previous efforts disclose all of the benefits of the present invention, nor do these previous patents teach or suggest all the elements of the present invention.

OBJECTS AND SUMMARY OF THE INVENTION

It is an object of the present invention to provide a drain cover assembly and plug which, when in the closed position, prevents the drainage of liquids from a sink.

It is another object of the present invention to provide a two-part drain cover assembly comprising a basket portion and a plug portion.

It is an additional object of the present invention to provide a drain cover assembly having a plug that is inserted into and remains within a drain pipe.

It is another object of the present invention wherein the basket portion is threadably engaged with the plug portion.

It is an additional object of the present invention wherein the drain cover assembly can be moved from a closed position, which prevents liquids from draining, to an open position, which allows liquids to drain, by rotating the basket with respect to the plug.

It is an additional object of the present invention to provide a drain cover assembly wherein the basket can be detached from the plug and the plug remains within a drain pipe of the drain.

It is still another object of the present invention to provide a drain cover and plug assembly which, when in the opened position, does not permit solid material to pass down the drain pipe when liquids are draining.

It is further an object of the present invention to provide a drain cover and plug assembly in which the basket has a plurality of apertures of a size which permits liquids to flow freely but does not permit solid objects to pass therethrough.

It is still further an object of the present invention to provide a drain cover and plug assembly in which the basket has an upper edge with indentations sized to permit easy gripping.

It is yet another object of the present invention to provide a drain cover assembly in which the basket is shaped to permit it to be easily cleaned.

It is even yet another object of the present invention to provide a drain cover assembly in which the basket has a generally flat bottom to permit it to be easily cleaned by scooping solid material therefrom.

It is an additional object of the present invention to provide a drain cover and plug assembly having screen about the outer upper edge of the basket to further prevent solid material from bypassing the assembly.

It is an additional object of the present invention to provide a drain cover and plug assembly in which the plug is cylindrically shaped and matches the size of a drain pipe.

It is an additional object of the present invention to provide a drain cover and plug assembly in which the plug is frustoconically shaped to fit into drain pipes of varying sizes.

It is an additional object of the present invention to provide a drain cover and plug assembly in which the plug has an internally threaded member extending therefrom for mating with an externally threaded member affixed to the bottom of the basket.

It is another object of the present invention to provide a drain cover assembly having a sealing plate on the underside of the basket to contact the plug to stop the drain.

It is another object of the present invention to provide a drain cover assembly that is easy to operate, simple in construction and inexpensive to manufacture.

It is even another object of the present invention to provide a drain cover assembly wherein a basket can be lifted with respect to a plug to open the assembly to let liquid drain from a sink, and the basket can thereafter be rotated to maintain the basket in an open position.

The present invention relates to an improved drain cover assembly for a sink. The assembly includes a generally cylindrical basket having a flat bottom. A sealing plate is attached to the underside of the flat bottom. A plurality of apertures sized to permit the drainage of liquid from the sink, but at the same time to prevent solid materials from passing therethrough, are located on the bottom of the basket about the sealing plate. An externally threaded member extends from the bottom of the sealing plate. The sealing plate includes an outer circumferential lip for sealing engagement with a plug. A screen may be positioned about the upper edge and sides of the basket to serve as an additional strainer of solid materials when the drain cover assembly is open. The plug may be cylindrically shaped or frustoconically shaped and is press fit into a drainpipe. The plug has an open upper end and a bottom surface. The bottom surface contains a plurality of apertures to allow for liquid to drain, but to prevent solid materials from passing therethrough. The bottom surface of the plug has an internally threaded member extending upwardly therefrom which mates with the threaded member extending from the bottom of the sealing plate. The lip of the sealing plate coacts with the upper edge of the plug to seal the drain cover assembly when the basket is threaded down on the plug. The assembly is in a closed position, thus preventing the drainage of liquids from the sink, when the threaded members are filly engaged, and in an open position, thereby allowing liquid to drain, when the threaded members are not fully engaged. Indentations may be provided on the basket to facilitate grasping thereof. The assembly can be moved from an open position to a closed position by rotating the basket with respect to the plug.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

The present invention relates to a drain cover assembly for use in a commercial or residential sink. The assembly includes a basket portion and a plug portion. The plug portion is sized to be positioned in a drain pipe. The basket portion is threadably engagable with the plug portion. The basket portion can be rotated with respect to the plug portion to open and close the drain.

Figure 1:
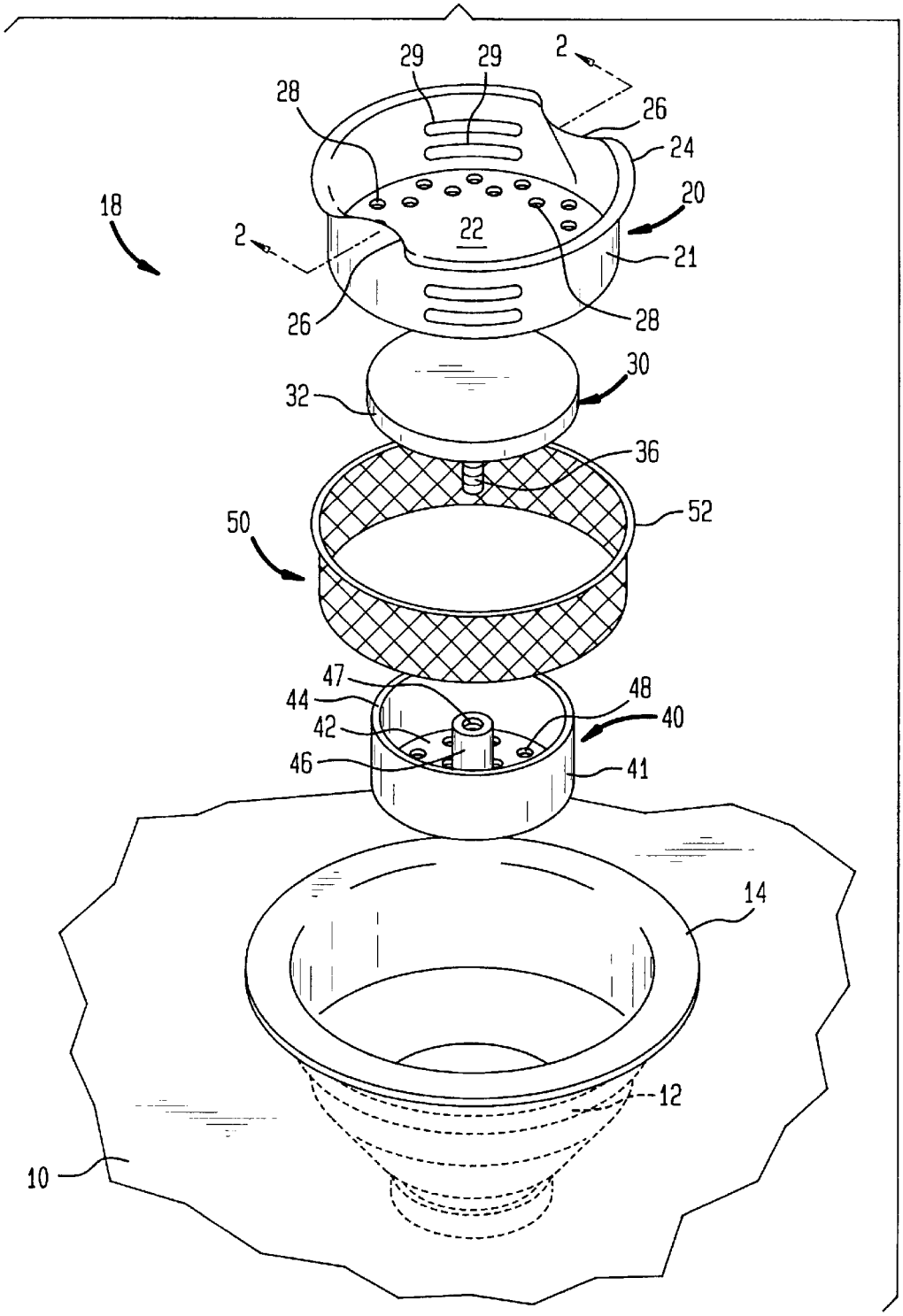
FIG. 1 is an exploded view of the drain cover assembly of the present invention.
Figure 2:
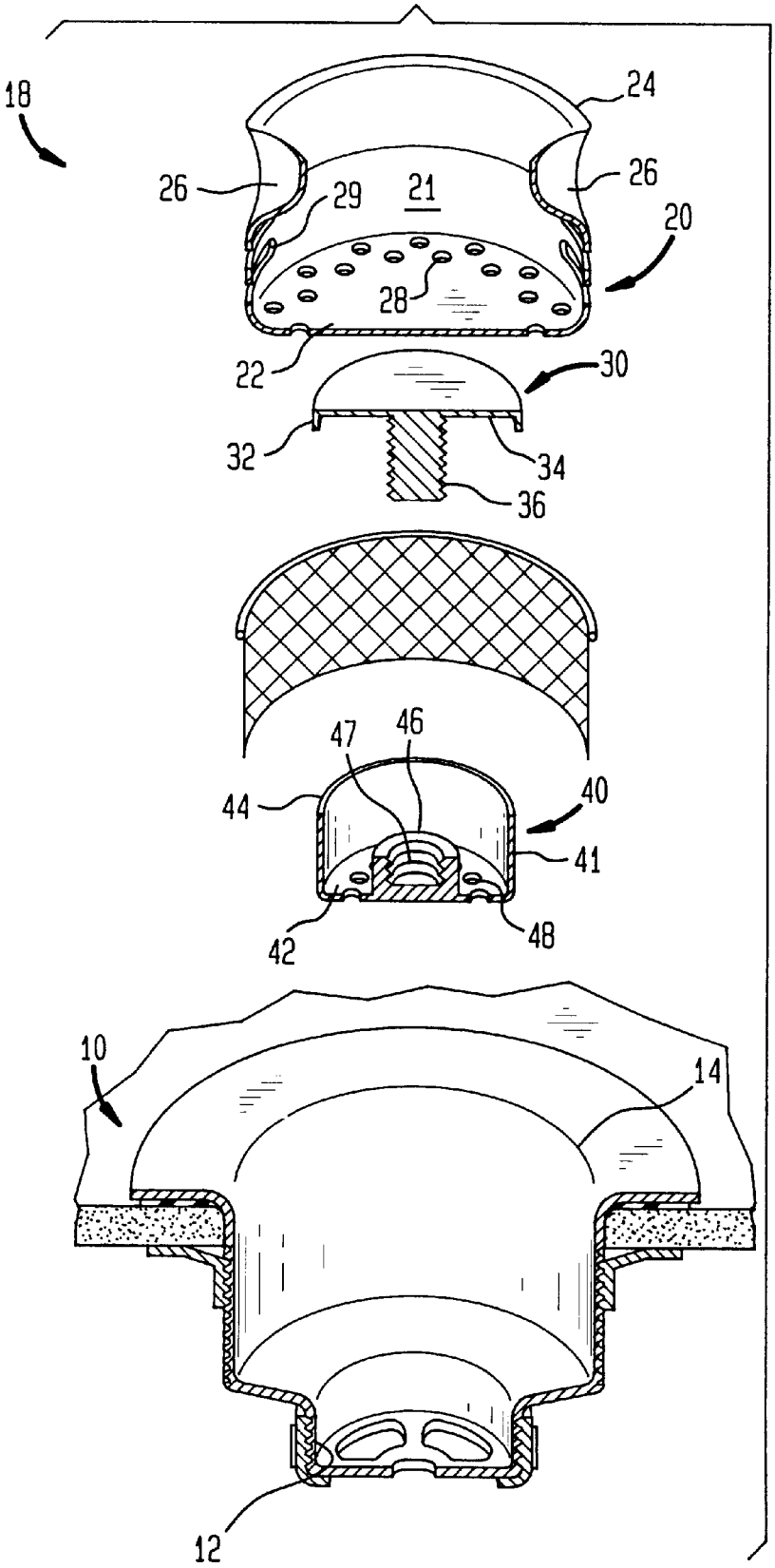
FIG. 2 is an exploded cross-sectional view of the assembly of FIG. 1.

Referring to FIGS. 1 and 2, exploded perspective and cross-sectional views of the drain cover assembly, generally indicated at 18, are shown. The basket 20 is generally cylindrically shaped, having a cylindrical side wall 21, an open upper end and a bottom surface 22. The upper edge 24 of the side wall 21 is preferably flanged outwardly to match the curvature of a sink drain opening 14, and may contain depressions 26 to facilitate gripping. The bottom surface 22 contains a plurality of apertures 28. The apertures 28 are preferably of a size sufficiently large to allow liquid to drain when the assembly 18 is in the open position, but not so large as to permit solid material to pass therethrough. The bottom surface 22 of the basket portion 20 is generally flat. The side wall 21 of the basket portion 20 may have apertures, such as elongated oval slots 29, or any other type of aperture, to allow the basket portion 20 to drain liquid rapidly.

In the preferred embodiment of the present invention, a sealing plate 30 is interconnected with the underside of the bottom surface 22 of the basket portion 20. The sealing plate 30 can be attached to the bottom surface 22 by any conventional means such as welding, soldering or some form of adhesion or by mechanical fasteners or in any other manner known in the art. Alternatively, the sealing plate 30 can be formed integrally with the bottom surface 22. The sealing plate 30 is sized and shaped to coact with the plug 40 as will be hereinafter discussed. The sealing plate 30 may include lip 32. Extending from the lower surface 34 of the sealing plate 30 is an externally threaded member 36, which also coacts with the plug 40 as will be hereinafter described. In another embodiment of the present invention, the externally threaded member 36 can extend directly from the bottom surface 22 of the basket portion 20, and the bottom surface 22 could include a central area without apertures which would coact with plug 40, thereby eliminating the need for the sealing plate 30.

Figure 7A:
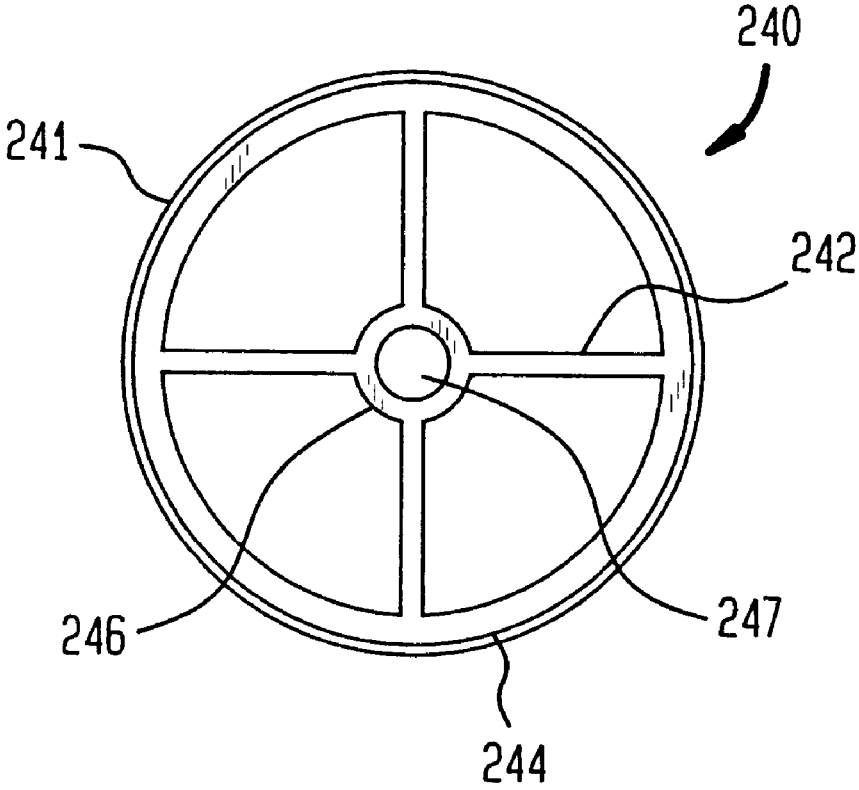
FIG. 7A is a top plan view of an alternate embodiment of the plug.
Figure 7B:
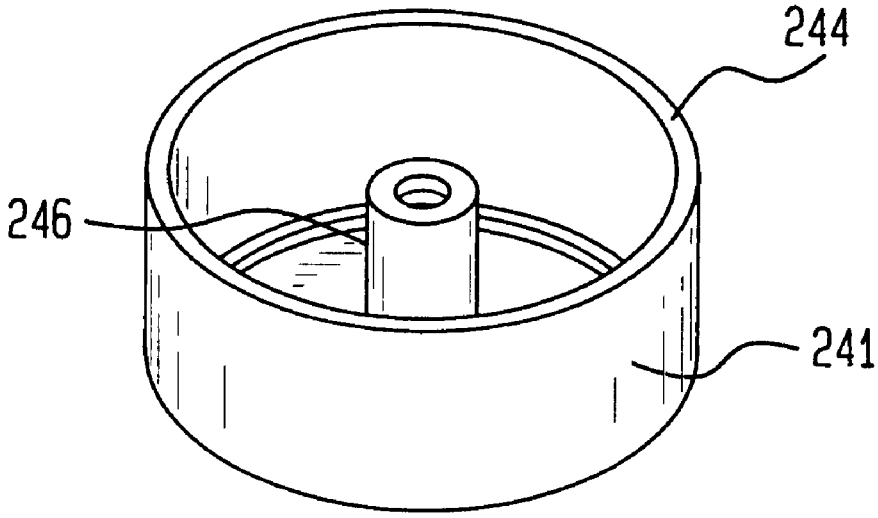
FIG. 7B is a perspective view of the plug shown in FIG. 7A.

The plug portion 40 of the drain cover assembly is sized and shaped to fit into a drain pipe 12 opening of a sink 10. The plug 40 has a generally cylindrical side wall 41 with an open upper end defined by upper edge 44. The plug 40 also has a bottom surface 42 which contains a plurality of apertures 48. The apertures 48 are of a size sufficient to allow liquids to drain but prevent the solid material from passing therethrough. Alternatively, as shown in FIGS. 7A and 7B, the plug 240 may have large apertures as will be hereinafter discussed. An internally threaded member 46 extends from the bottom surface 42 within the plug 40. This threaded member 46 has internal threads 47 for threadably engaging the threaded member 36 extending from the sealing plate 30. In operation, the plug 40 is positioned within the drain pipe 12 and the basket portion 20 can be interconnected therewith by threadably engaging the threaded member 36 with the internally threaded member 46 of the plug 40.

Figure 3:
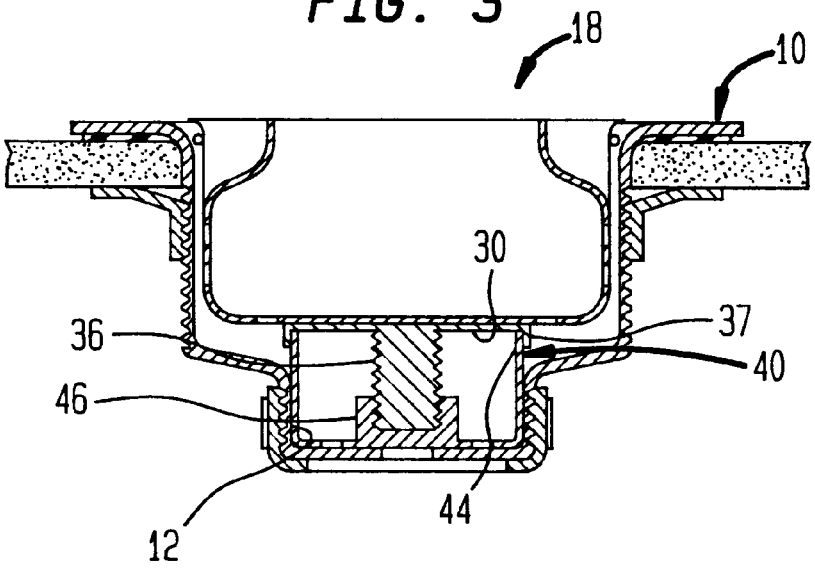
FIG. 3 is a cross-sectional view of the assembly of FIG. 1 in which the assembly is in the closed position so as to prevent drainage.

The sink 10 can be of any conventional material such as porcelain or stainless steel. Referring to FIG. 2, the drain 14 has an opening extending to a drain pipe 12. Referring to FIG. 3, a cross-sectional view of an embodiment of the drain cover assembly 18, shows the threaded members 36 and 46 fully engaged to close the drain cover assembly 18 to prevent drainage of liquid. In the fully engaged position, the upper edge 44 of the plug 40 contacts and engages the sealing plate 30 to close the drain. Lip 32 surrounds the upper edge 44 to further assist in closing the drain.

Figure 4:
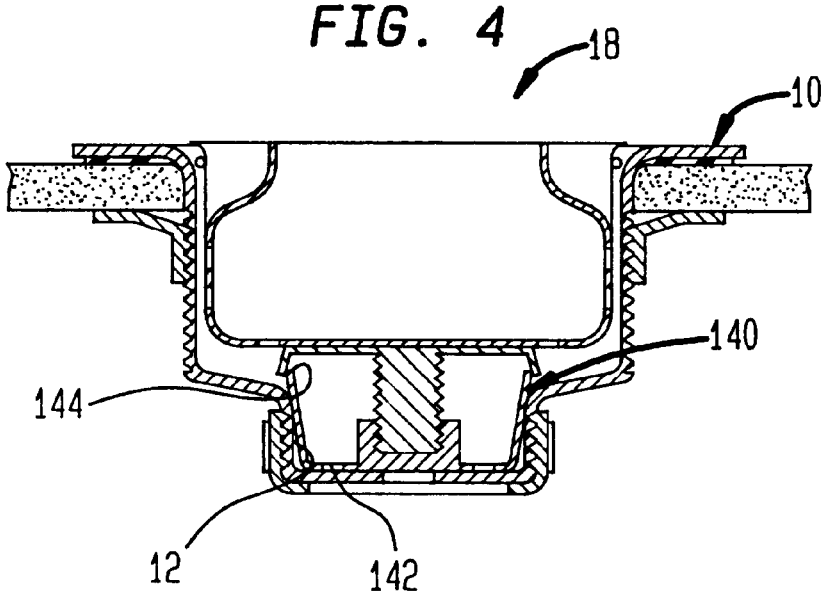
FIG. 4 is a cross-sectional view of another embodiment of the assembly of FIG. 1 with an alternate embodiment of the plug.

FIG. 4 shows a cross-sectional view of another embodiment of the drain cover assembly 18. Again, the threaded members 36 and 46 are fully engaged so as to prevent drainage of liquids. In this embodiment, the plug 140 is frustoconically shaped such that the plug 140 tapers from a relatively wide upper edge 144 to a more narrow bottom surface 142. The frustoconical shape of the plug allows it to be used with drain pipes 12 of varying sizes.

Figure 5:
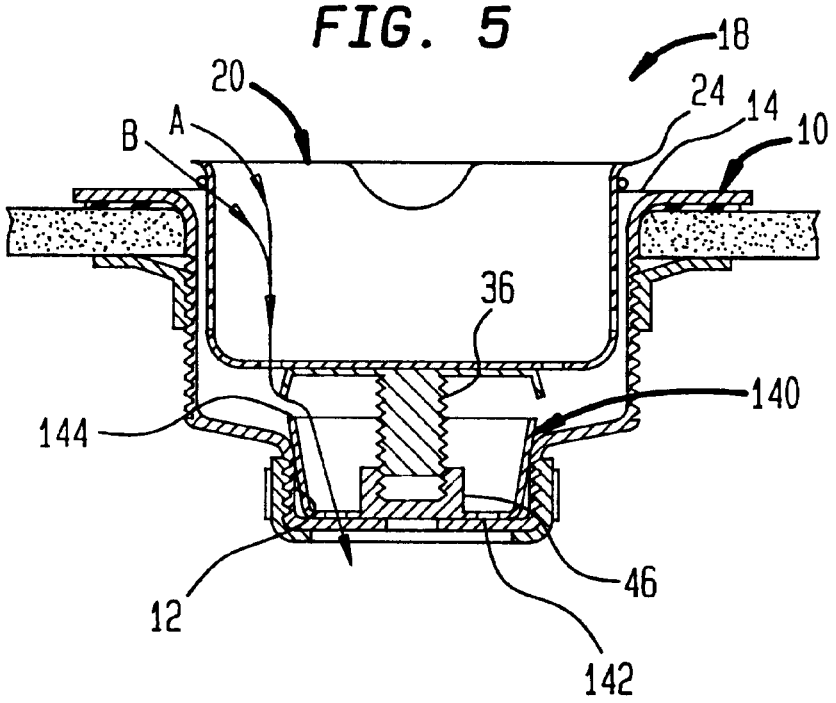
FIG. 5 is a cross-sectional view of an embodiment of the assembly of FIG. 4 in which the assembly is in the opened position permitting liquids to flow therethrough.

FIG. 5 shows a cross-sectional view of the drain cover assembly shown in FIG. 4 with the basket portion 20 rotated 90 degrees to back off the threaded members 36 and 46 with respect to each other to open the assembly 18 to allow liquid to drain through the drain cover assembly 18. In this position, the upper edge 24 of the basket portion 20 is raised above the drain opening 14 of the sink 10, and the sealing plate 30 is spaced from the upper edge 144 of plug 140 to open the drain. Liquids can then flow through the drain as shown by Arrows A and B, i.e. liquid can flow through the open top or oval slots 29 in the basket portion 20, through the apertures 28 in the bottom surface 22, through the open top of plug 140, through the apertures 148 in the bottom surface 142 of plug 140 and down the drain 14.

In order to ensure that only liquids flow down the drain 14, a screen 50 as shown in FIG. 1, may be used to prevent solid material from lodging in the drain 14. The screen 50 is generally cylindrical in shape having an upper edge 52 which attaches with the upper edge 24 of the basket 20. The screen 50 can be manufactured from any suitable material known in the art, such as a wire mesh. When used, the screen 50 fits between the upper edge 24 of basket 20 and drain opening 14 of sink 10 to prevent solid material from passing therethrough, but allowing liquid to drain therethrough.

Figure 6:
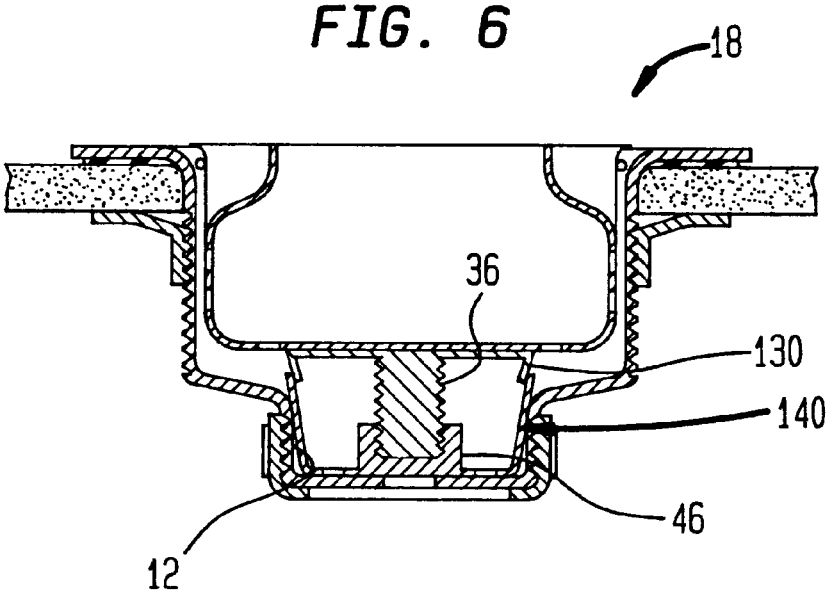
FIG. 6 is a cross-sectional view of another embodiment of the assembly of FIG. 4 showing an alternate embodiment of the sealing plate.

FIG. 6 shows a cross-sectional view of another embodiment of the drain cover assembly 18, wherein the sealing plate 130 has a circumferential lip 132 that extends inwardly of the plug 140 when the threaded members 36 and 46 are fully engaged, such that the outer surface of the lip 132 contacts the upper edge 144 of plug 140 to stop the drain.

Because the drain cover assembly 18 of the present invention includes a generally flat bottom surface 22, when solid material starts to collect thereon when liquid is drained, the solid material can be easily removed by a person. The person merely uses his or her hand to scoop the solid material from the basket 18 by cupping his or her hand and dragging his or her fingers along the bottom surface 22 to remove solid material therefrom. This alleviates the need to remove the basket 20 to clean the drain cover assembly 18.

FIGS. 7A and 7B show another embodiment of the plug portion 240 of the drain cover assembly. The plug 240 has a generally cylindrical side wall 241 with an open upper end defined by upper edge 244. The plug 240 of this embodiment has a bottom surface comprised of four spokes 242 which extend between side wall 241 and the threaded member 246. The threaded member 246 has internal threads 247 for threadably engaging the threaded member 36 extending from the sealing plate 30.

Figure 8:
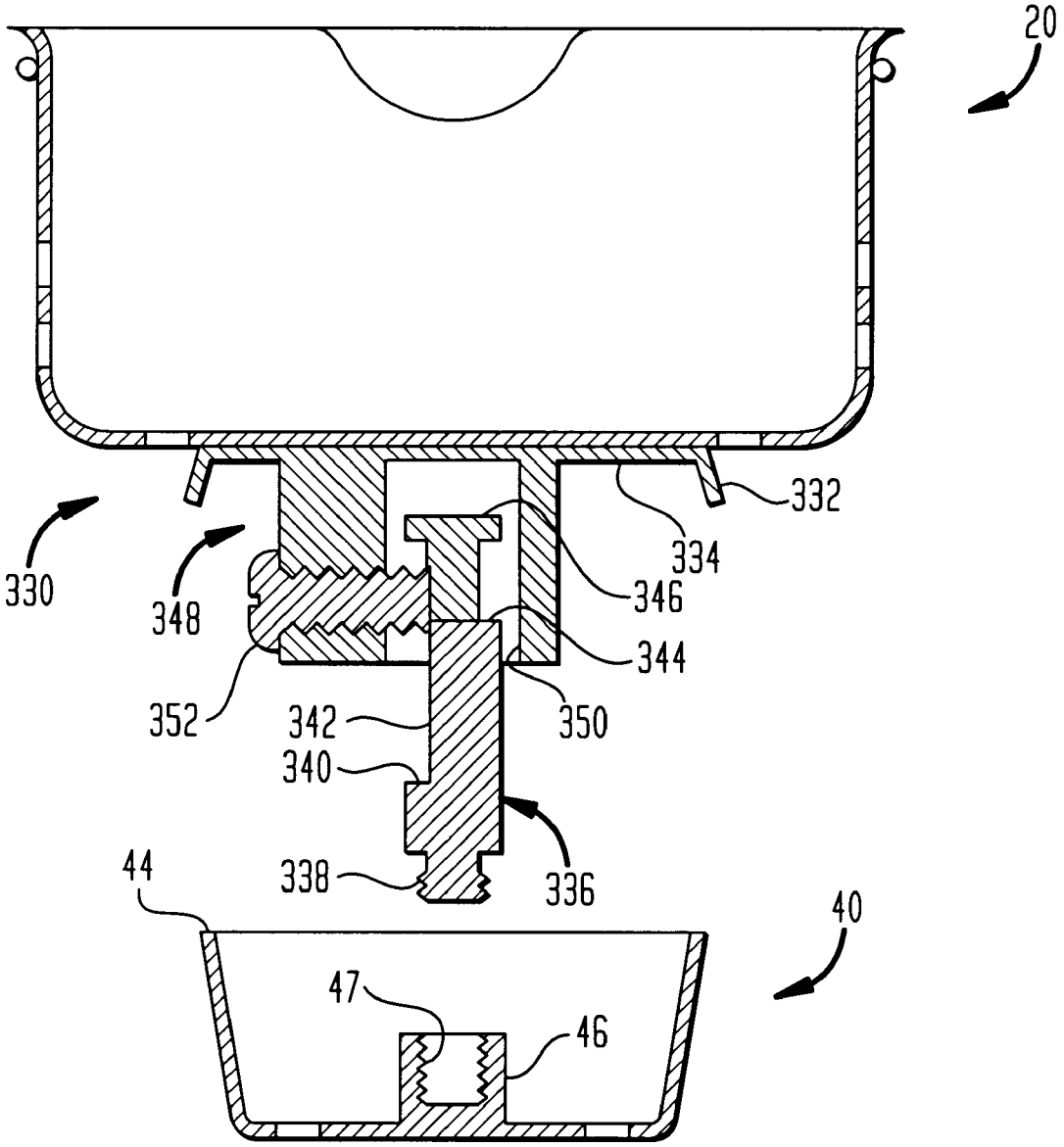
FIG. 8 is a cross-sectional view of another embodiment of the drain cover assembly of the present invention.

FIG. 8 shows another embodiment of the drain cover assembly of the present invention. In this embodiment, as will be discussed, the basket is not rotated with respect to the plug to open the drain, but is rather lifted up and away from the plug to open the drain. Thereafter, as will be hereinafter discussed, the basket can be rotated with respect to the plug to lock the plug in an opened position.

The basket 20 includes a sealing plate, generally indicated at 330, interconnected with the basket 20 in accordance with the previous embodiments of the present invention. The sealing plate 330 includes a lip 332 and a lower surface 334. Interconnected with the ceiling plate 330 is an adjustment sleeve 348 which has an outer wall and a sleeve channel 350 for receiving engagement member 336. Threaded through the adjustment sleeve 338 and into the sleeve channel 350 is a set screw 352 that can be used to adjust the device. The engagement member 336 includes a threaded end 338 for threaded engagement with the threads 47 of the threaded member 46 of plug 40. Once the threaded end 338 of engagement member 336 is threaded down onto the plug, the apparatus can be inserted into a sink drain and operated to open and close the sink drain. As with the previous embodiments, the plug 40 remains in the drain. The engagement member includes two shoulders, namely, bottom shoulder 340 and upper shoulder 344 interconnected by adjustment shaft 342.

In a first closed position, the engagement member 336 is fully recessed into the sleeve channel 350 of adjustment sleeve 348, the set screw 352 contacting the bottom shoulder 340 and the upper edge 44 of the plug 40 contacting the lip 332 or bottom surface 334 of ceiling plate 330. When one desires to open the plug to allow liquid to drain through the device, one lifts the basket 20 with respect to the plug 40, essentially pulling the adjustment sleeve 348 up along the adjustment shaft 342. Note that the set screw 352 is positioned to allow the free movement of the adjustment sleeve 348 with respect to the adjustment shaft 342. Also, it should be noted that cap 346 extends over the adjustment shaft 342 and interferes with the leading end of the set screw 352 to prevent the basket 20 from being withdrawn off of the engagement member 336 and plug 40. After the drain is opened, if one lets go of the drain, the adjustment sleeve 348 will slide down over the engagement member 336 to close the drain. If one desires to maintain the drain in an open configuration, one can rotate the basket such that the set screw 352 is positioned over upper shoulder 344 which interferes therewith and prevents the adjustment sleeve 348 from sliding down along the engagement member 336. Then, when one wants to re-close the drain, one can merely rotate the basket such that the set screw 352 is out of interference with the upper shoulder 344 and the adjustment sleeve 348 is free to slide down the engagement member 336 to close the drain.

Having thus described the invention in detail, it is to be understood that the foregoing description is not intended to limit the spirit and scope thereof. What is desired to be protected by Letters Patent is set forth in the appended claims.

What is claimed is:

1. A drain cover assembly comprising:

a cylindrical basket having a bottom surface and an open top, the bottom surface having a plurality of apertures;

sealing means on the underside of the basket for sealing the assembly;

a threaded shaft extending from the sealing means;

a plug having a circumferential outer wall sized to be removably press fit into an opening of a drain pipe, the plug having a lower surface and an open top; and the lower surface having a plurality of drain apertures and a central threaded aperture;

wherein the threaded shaft and the central threaded aperture coact to threadably engage the basket with the plug, the basket rotatably moveable from a first closed position wherein the sealing means engages the top outer wall of the plug, to a second open position wherein the sealing means is spaced away from the top outer wall of the plug.

2. The assembly of claim 1 wherein the sealing means comprises comprises a plate mounted on the underside of the bottom surface of the basket.

3. The assembly of claim 2 wherein the plate further comprises a circumferential lip.

4. The assembly of claim 1 wherein the circumferential lip is frustoconically shaped.

5. The assembly of claim 1 wherein the plug is frustoconically shaped.

6. The assembly of claim 1 wherein the bottom surface of the basket comprises a flat, planar surface.

7. The assembly of claim 1 wherein the bottom surface of the basket comprises a flat, uninterrupted surface.

8. The assembly of claim 1 wherein the top of the basket has opposing depressions for one to grasp the basket.

9. The assembly of claim 1 further comprising a screen positioned about the basket.

10. A method for stopping a drain comprising:

providing a plug having a threaded aperture, a plurality of drain apertures, and a circumferential outer wall sized to be removably press fit into a drain pipe;

providing a basket having a flat bottom with a plurality of apertures, a sealing means attached to a bottom surface of the flat bottom for sealing with the outer wall of the plug, and a threaded shaft extending from a bottom surface of the sealing means; and the threaded shaft threadably engages the threaded aperture to engage the sealing means and the outer wall of the plug.

11. The method of claim 10 wherein the flat bottom of the basket is uninterrupted and the method includes the step of cleaning the basket by scooping solid material from the flat, uninterrupted bottom.

12. The method of claim 11 wherein the step of scooping comprises sweeping the flat, uninterrupted bottom with one's fingers.

13. The method of claim 10 wherein the plug is removably press fit into engagement with a drain pipe, and the method further comprises the step of cleaning the plug by removing the plug from a drain pipe, cleaning the plug, and re-inserting the plug into the drain pipe.

14. The method of claim 10 wherein the drain is stopped and unstopped by rotating the basket to engage or disengage the sealing means.

15. The method of claim 14 wherein the step of rotating the basket comprises grasping the basket by indentations formed at a top edge of the basket.

* * * * *